United States Patent [19]

Capra et al.

[11] 4,222,500

[45] Sep. 16, 1980

[54] NON-PROPELLANT, DURATION SPRAY DISPENSER WITH POSITIVE SHUT OFF VALVE

[75] Inventors: Nicholas G. Capra, East Hanover, N.J.; Roy Hammett, Miami, Fla.

[73] Assignee: James D. Pauls, Limited, Miami, Fla.

[21] Appl. No.: 927,274

[22] Filed: Jul. 24, 1978

Related U.S. Application Data

[63] Continuation-in-part of Ser. No. 862,551, Dec. 20, 1977.

[51] Int. Cl.[2] ..... B05B 11/02

[52] U.S. Cl. ..... 222/207; 137/510; 137/614.19; 222/321; 222/380; 222/383; 222/499

[58] Field of Search ..... 222/207, 209, 321, 335, 222/336, 340, 341, 376, 380, 383, 385, 396, 397, 499, 496, 498, 402.2; 239/331, 333; 417/273, 462, 538; 137/510, 614.19

[56] References Cited

U.S. PATENT DOCUMENTS

| | | | |
|---|---|---|---|
| 3,658,209 | 4/1972 | Freeman et al. | 222/335 X |
| 3,777,945 | 12/1973 | Nozawa et al. | 222/394 |
| 3,921,861 | 11/1975 | Kondo | 222/340 X |
| 3,923,250 | 12/1975 | Boris | 222/321 X |
| 4,088,425 | 5/1978 | Bennett | 222/380 X |

*Primary Examiner*—Robert J. Spar
*Assistant Examiner*—Fred A. Silverberg
*Attorney, Agent, or Firm*—Oblon, Fisher, Spivak, McClelland & Maier

[57] ABSTRACT

A non-propellant operated, duration spray dispenser includes structure for mechanically pressurizing the material to be dispensed by pumping it into an expansible bulb for storage under pressure for subsequent dispensing of the material, and a snap-acting positive shut off valve is provided to terminate discharge of the material when pressure falls below a predetermined minimum.

22 Claims, 45 Drawing Figures

FIG. 1
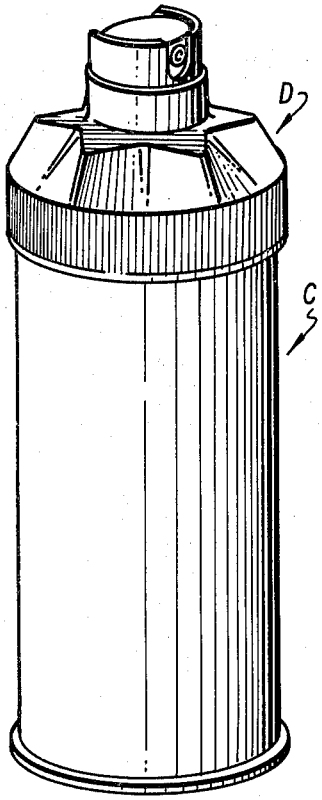
FIG. 6
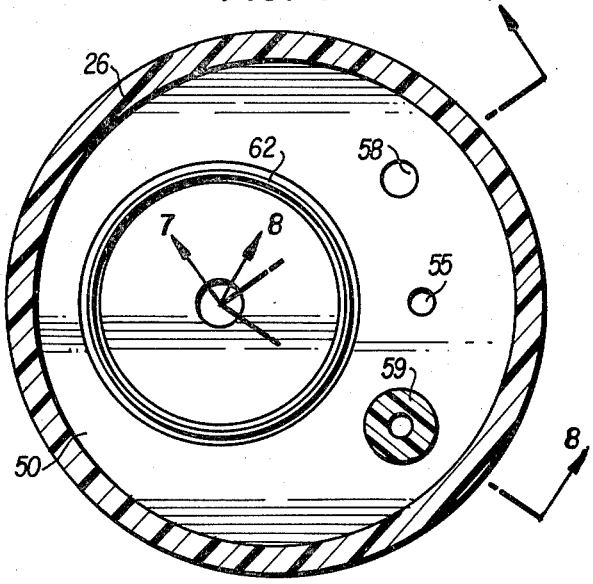
FIG. 7
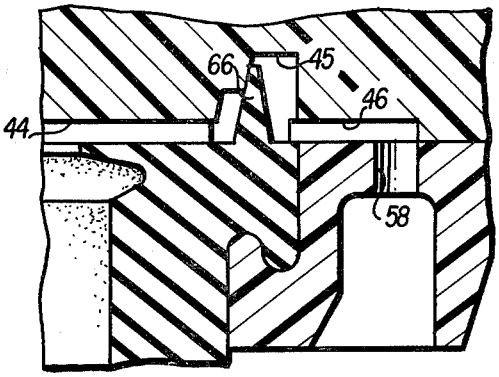
FIG. 8
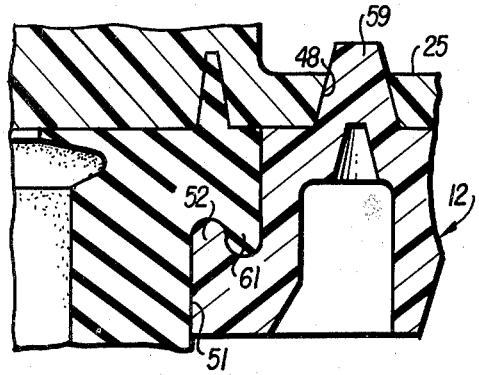
FIG. 10
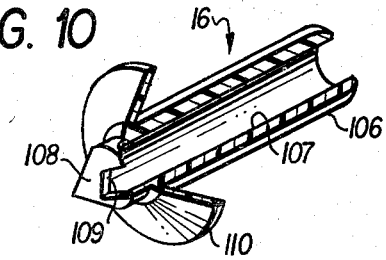
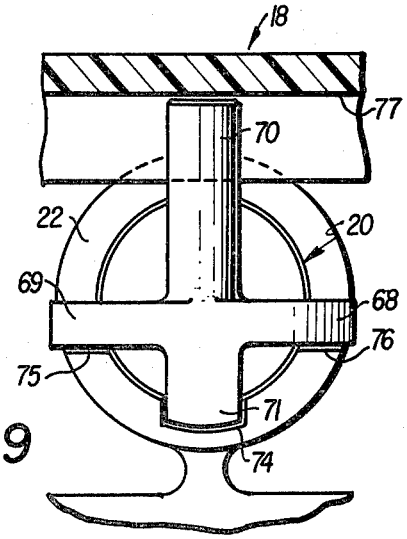
FIG. 9

FIG. 11
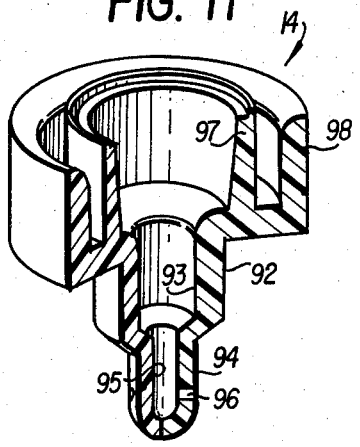
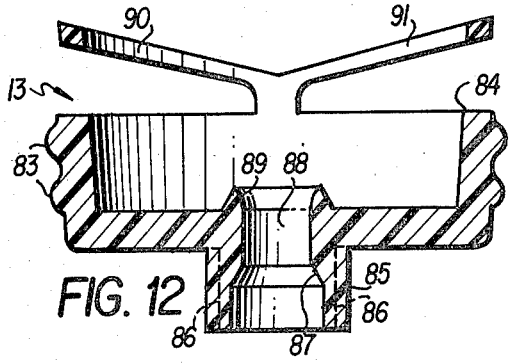
FIG. 12
FIG. 13
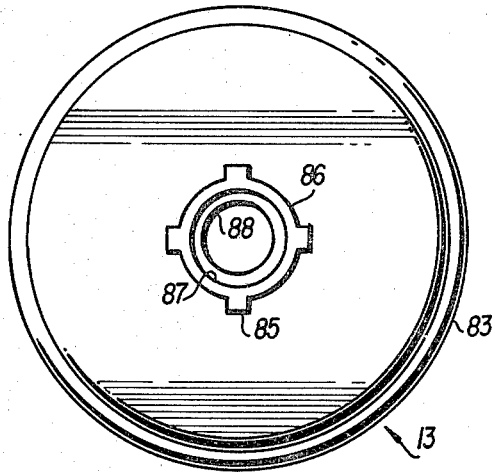
FIG. 14
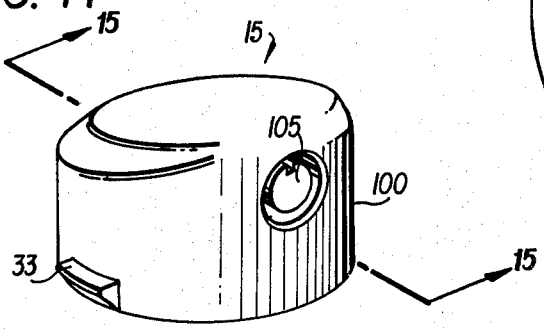
FIG. 15
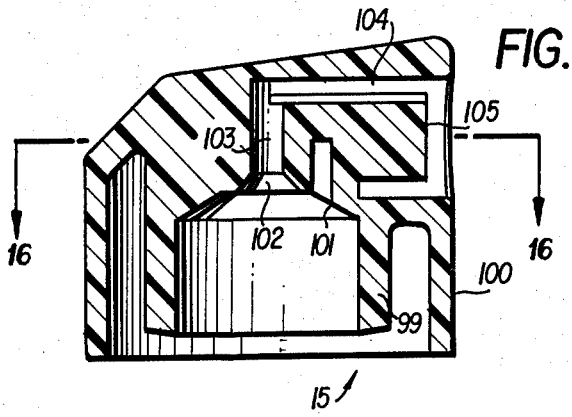
FIG. 16
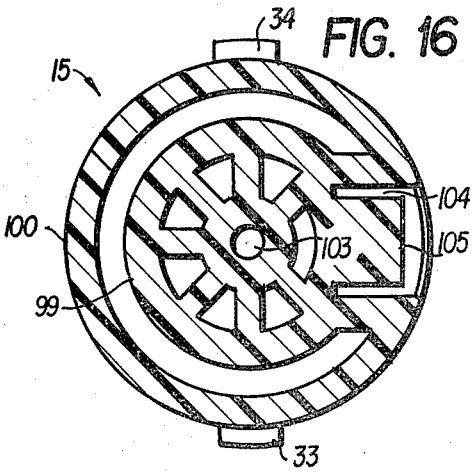

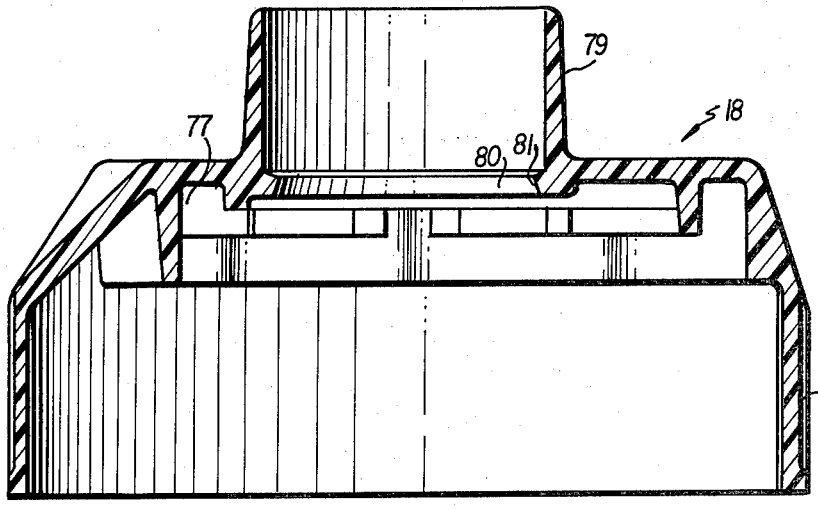
FIG. 21
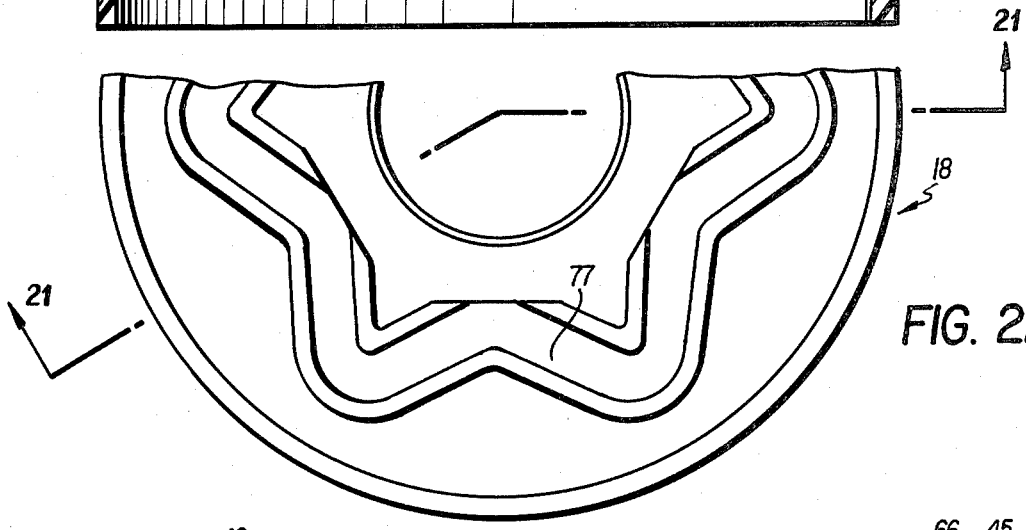
FIG. 22
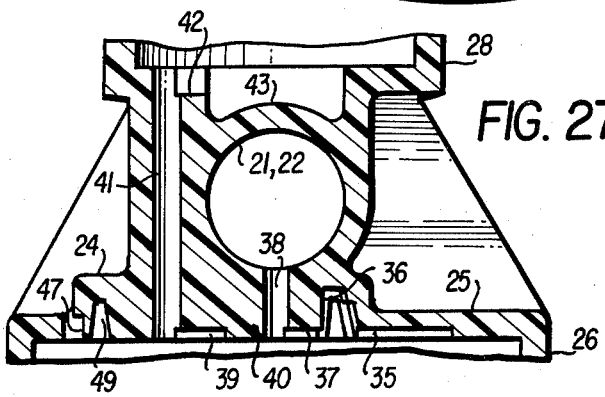
FIG. 27
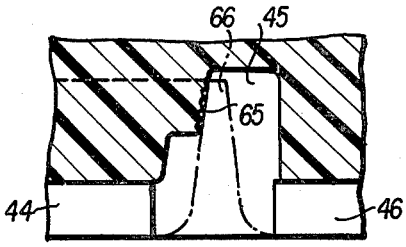
FIG. 28
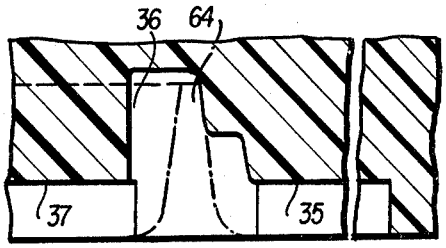
FIG. 29
FIG. 30
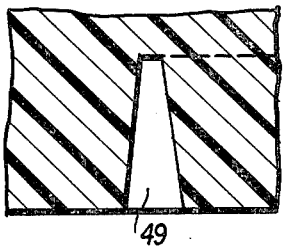

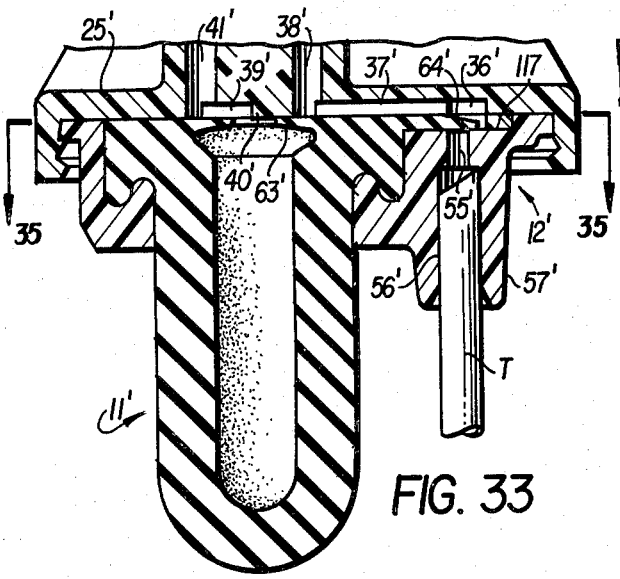
FIG. 33
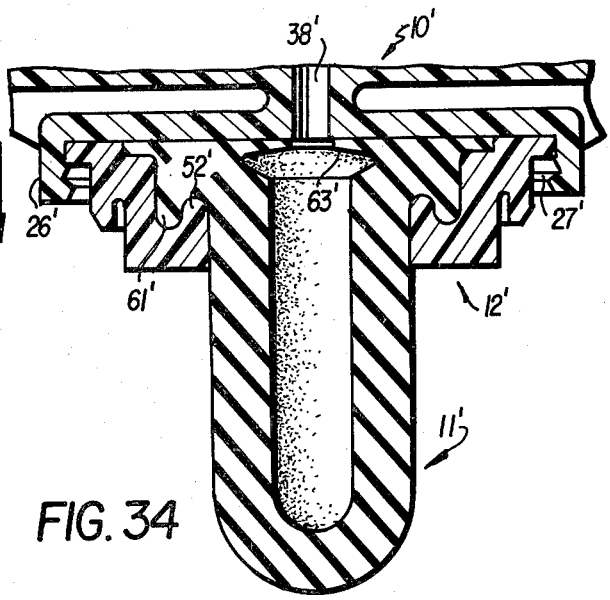
FIG. 34
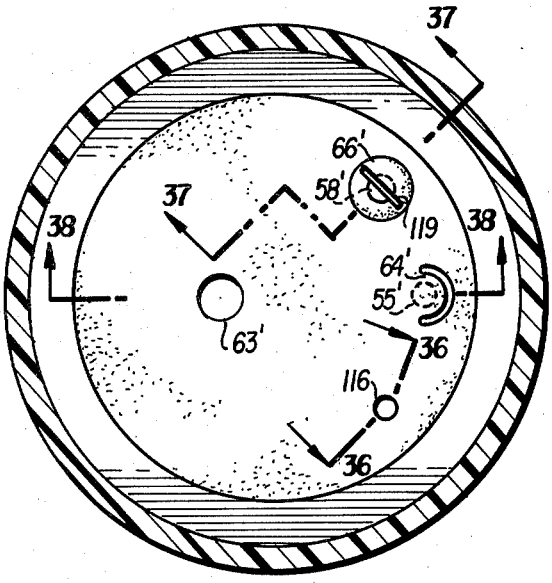
FIG. 35
FIG. 36
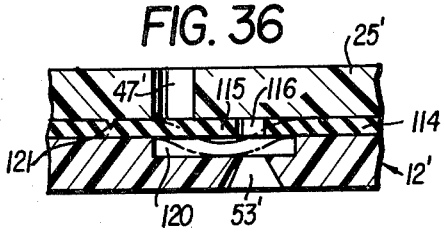
FIG. 37
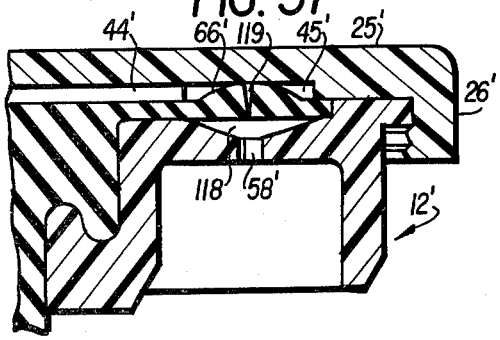
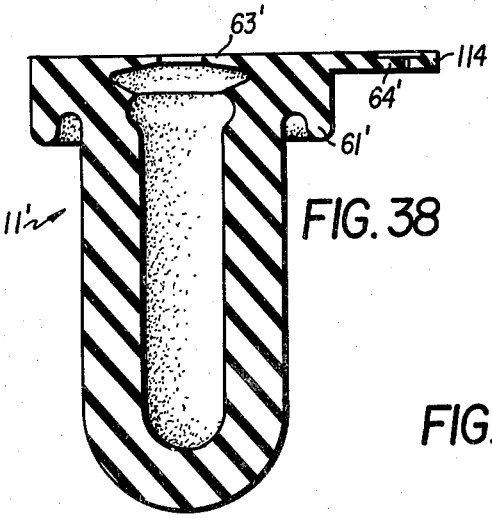
FIG. 38
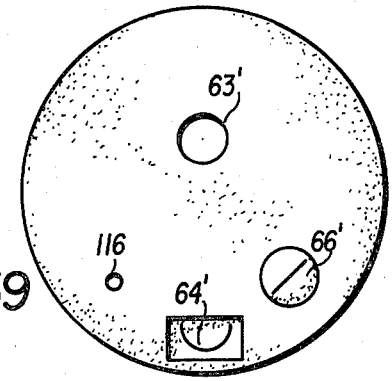
FIG. 39

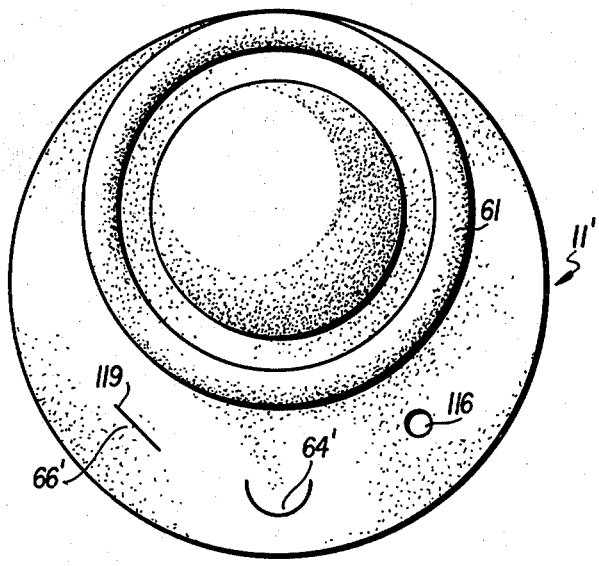
FIG. 40
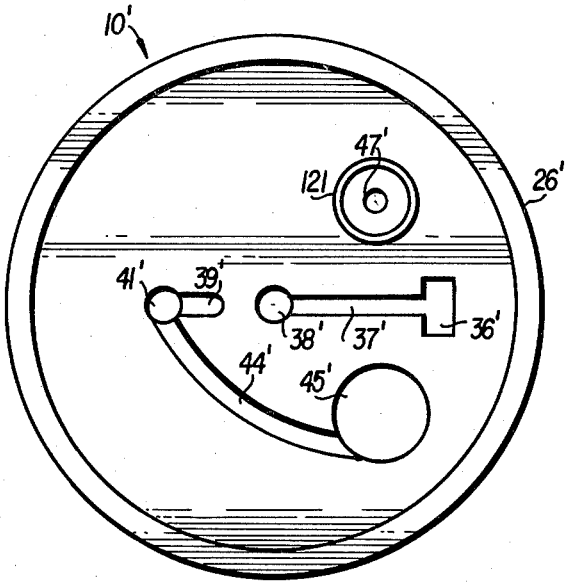
FIG. 44
FIG. 45
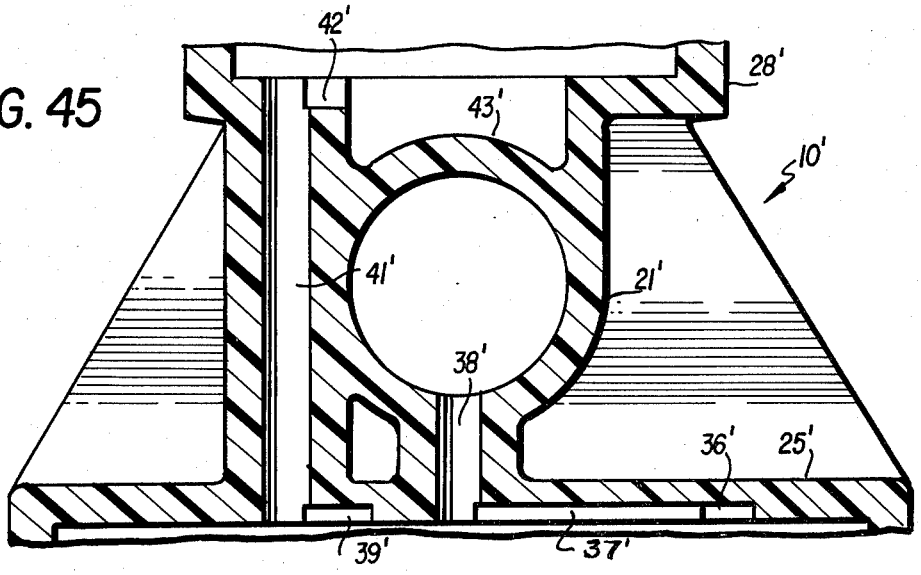

NON-PROPELLANT, DURATION SPRAY DISPENSER WITH POSITIVE SHUT OFF VALVE

BACKGROUND OF THE INVENTION

This application is a continuation-in-part of application Ser. No. 862,551, entitled Mechanically Operated Dispensing Device with Expansible Bulb, filed Dec. 20, 1977, which is, in turn, an improvement over prior copending application Ser. No. 729,830, filed Oct. 5, 1976, now U.S. Pat. No. 4,167,941.

This invention relates generally to dispensing devices, and more particularly, to an aerosol dispenser which does not rely upon chemical propellants and the like for discharging the product dispensed.

Although propellant operated aerosol dispensers are exceptionally convenient spray devices and have enjoyed a growth pattern achieved by few packaging systems, they have many disadvantages. For example, fluorocarbon propellants have gained widespread usage, but recent evidence indicates that the ozone layer is being depleted by these chemical propellants, and many deaths and illnesses are reported each year due to the use or inhalation of the chemical propellants by users of such products. For example, in the close quarters, such as bath rooms, where such products are typically used, unhealthy concentrations of the propellants may be encountered. Thus, the toxicity of these materials has brought them under increasing attack by consumer's groups and by the government. Legislation has even been proposed and passed banning such propellants for most uses by Apr. 15, 1979.

Therefore, the industry has begun packaging products with hydrocarbon materials as the propellant. For example, butane, isobutane and propane are commonly used, and these are essentially the same flammable explosives used for lighter fluid or in gas stoves.

The hydrocarbon propellants, although not having the high toxicity of fluorocarbons, are nonetheless generally regarded as being unsafe for use as a propellant, and are toxic, in addition to which they are highly flammable. A federal task force warned that the hydrocarbons could have a blowtorch effect and should not be used in personal care products. In fact, most personal care products have a flammable base, such as alcohol, and the use of another flammable product as the propellant, creates a potentially lethal bomb. The industry itself recognizes these dangers, and in the years before fluorocarbons became controversial, considered hydrocarbons too flammable and explosive for use in personal care products.

The Consumer Product Safety Commission found, in a 1974 study, that "The average severity rating estimated for aerosol related injuries was higher than the average severity rating estimated for all other consumer product injuries." Moreover, the number of injuries is increasing each year, with 4,457 aerosol related injuries in 1974 , 5,656 in 1975, 5,798 in 1976 and 6,059 in 1977. This number of injuries is not surprising when it is considered that hydrocarbon aerosols can explode and burn when exposed to flame, or left in the sun, or stored under a kitchen sink while very hot water runs down the drain.

One step that has been taken in an attempt to reduce the dangerous nature of such devices, is to add methylene chloride, but this product is under suspicion as a carcinogenic.

Moreover, shipping, handling and storing of the conventional, pressurized containers requires special procedures, and pressurized aerosol dispensers require special disposal precautions. Further, strict requirements must be met and procedures followed in connection with the filling of aerosol dispensers utilizing chemical propellants; and many products cannot be packaged in such devices because of chemical incompatibility between the product to be dispensed and the chemical propellant.

Many efforts have been made in the prior art to produce a device which does not have the problems of propellant operated dispensers. For example, roll-ons and other sticks are being marketed, and attempts have been made at developing finger operated pump dispensing devices or trigger dispensing devices which do not rely upon chemical propellants for effecting pressurized discharge of the product. However, such devices have only partially solved the problem of providing a convenient yet safe and effective dispensing device. For example, users of the finger operated pump and trigger devices experience finger fatique, and because of the action or force exerted to operate such devices, it is difficult for the user to consistently achieve accuracy; and except for some devices, the pressure does not remain constant throughout a discharge cycle. Thus, such devices are unable to duplicate propellant operated dispenser performance. For example, although a fine spray might be achieved initially during a discharge cycle, near the end of the discharge cycle the pressure deteriorates rapidly and the spray becomes a wet stream or dribble.

There are many other problems with existing propellant operated aerosol devices, and with pump or trigger operated spray devices. For example, when chemical propellants are used, the product discharge may feel cold to the skin of the user, and the design and structure of the container is determined by the pressure which must be withstood. On the other hand, some finger operated pumps and triggers are not capable of generating sufficient pressure to obtain a fine mist or suitably atomized spray for use with many products, such as personal care products in the nature of cosmetics and hair sprays and the like, and the duration of spray obtained is limited in most instances by the length of stroke of the pump or trigger.

U.S. Pat. Nos. 3,761,002 and 3,921,861 are exemplary of some of the prior art efforts to solve the problems with propellant operated devices. Other U.S. patents which disclose various approaches to solving the problems discussed above are: Nos. 3,746,260, 3,777,945, 3,790,034, 3,799,448, 3,865,313 and German Pat. No. 2,315,467 of 1973. All of these prior art patents are either excessively expensive and difficult to manufacture, and/or do not provide sufficient pressure for the desired spray pattern, and/or do not provide sufficient spray duration and/or the user experiences finger fatique and spray misdirection when using the devices.

SUMMARY OF THE INVENTION

Applicants' prior applications, noted above, as well as the present invention, are directed to devices which solve most, if not all, of the problems inherent in other prior art devices, by providing structures which obtain long duration and high pressure, and yet which are economical to make and easy to use, and which do not use chemical propellants. Moreover, the devices and containers of applicants' prior applications, as well as the present invention, may be made of biodegradable materials, or any other suitable material; and the containers may be made of blow-molded, inexpensive plastic, or inexpensive metal, such as recyclable aluminum.

Additionally, the present invention provides an even more economical structure than applicants' prior art applications, noted above, in that fewer parts are required, and more simple structure is thus obtained. Further, a unique, snap-acting positive shut off valve is incorporated in the device of the present invention to terminate discharge of material when the pressure falls below a predetermined minimum, to thereby prevent a "wet" stream dribble of material near the end of a discharge cycle, and a single economical, combined expansion or accumulating chamber and valving structure are provided in the preferred form.

More specifically, in accordance with the present invention, a minimum number of parts are used to obtain a relatively high pressure, long duration discharge of material whereby the performance characteristics of prior art propellant operated dispensing devices are obtained. In this connection, an expansible bladder has valving means formed integrally therewith for cooperation with a manifold member to control flow to and from charging pistons whereby rotation of an actuator causes reciprocation of the pistons to charge material into the expansible bladder or chamber for storage of the material under pressure. A discharge valve is provided in the outlet from the expansible bladder to prevent flow therefrom until the valve is opened by manual engagement with a discharge member. Thereafter, the pressure of material stored in the expansible bladder acts on the valve to open it to enable discharge of material at a predetermined elevated pressure. However, when the pressure falls below a predetermined minimum, the valve snaps to a closed position, abruptly terminating flow and preventing a wet discharge or dribble of material from the device.

OBJECTS OF THE INVENTION

Accordingly, it is an object of this invention to provide an economical and easy to manufacture dispensing device for discharging a wide variety of products under sufficient pressure to obtain a fine mist or spray thereof, wherein no chemical propellants are used.

Another object of the invention is to provide an aerosol dispensing device which does not rely upon chemical propellants for obtaining pressurized discharge of the product being dispensed, and wherein a long duration, high pressure spray or discharge of the product is obtained.

A further object of the invention is to provide an aerosol dispensing device which utilizes mechanical means to pressurize the product for discharge of the product, whereby any suitable and desired material may be used for constructing the container for the product and the container may be manufactured or styled with any desired design without regard to strength or structural requirements to contain pressure, as is necessary with prior art pressurized or chemical propellant devices.

An even further object of the invention is to provide a mechanically operated dispensing device constructed to obtain duration, high pressure spray wherein the dispenser is entirely self contained for application to either a new or existing container.

Yet another object of the invention is to provide an aerosol dispensing device which does not rely upon chemical propellants for obtaining pressurized discharge of the product being dispensed and wherein the dispensing device can be accomodated on all conventional piston and aerosol filling lines.

Still another object of the invention is to provide an aerosol dispenser which is capable of achieving a high pressure, long duration spray of product and which meets all known and anticipated government legislation concerning the regulation of such dispensers, and which has provision for releiving excess pressure.

Still another object of the invention is to provide an aerosol dispenser which is capable of achieving high pressure, long duration sprays wherein there are no metal parts required in the construction of the dispensing device.

An even further object of the invention is to provide an aerosol dispenser for dispensing product under pressure and over a relatively long duration of time wherein the device is constructed such that product pressurized therein is gradually leaked back into the container, whereby the device cannot be charged with fluid or product and then left unattended for subsequent accidental or inadvertent discharge by a child or the like.

A further object of the invention is to provide an aerosol dispensing device wherein spray performance is not affected by the position of the dispenser.

A still further object of the invention is to provide an aerosol dispensing device, wherein an expansible bulb is used for storing material under pressure for subsequent discharge of the material, and a positive shut of valve is provided for terminating flow when the pressure falls below a predetermined minimum.

An even further object of the invention is to provide a unique, snap-acting positive shut off valve for terminating flow from an aerosol dispenser when the pressure falls below a predetermined minimum pressure, to thus prevent a "wet" discharge or dribble of the material near the end of a dispensing cycle.

Yet another object of the invention is to provide a unique, combined accumulating chamber and valving structure, which is simple, and economical in construction.

Other objects of the invention will become apparent upon a further study of the drawings and description which follow.

BRIEF DESCRIPTION OF THE DRAWINGS

FIG. 1 is a perspective view of a container having the dispensing device of the invention attached thereto.

FIG. 6 is a view in section of the top of the expansible bladder and retainer and is taken along line 6—6 in FIG. 3.

FIG. 7 is a greatly enlarged, fragmentary view in section taken along line 7—7 in FIG. 6.

FIG. 8 is a view similar to FIG. 7 taken along line 8—8 of FIG. 6.

FIG. 9 is an enlarged fragmentary view in section taken along line 9—9 in FIG. 4.

FIG. 10 is an enlarged fragmentary view, with portions shown in section, of the snap acting positive shut off valve used in the dispensing device of the invention.

FIG. 11 is a greatly enlarged fragmentary view with portions in section of the discharge valve member of the invention.

FIG. 12 is a greatly enlarged view in section of the discharge valve seat and spring member.

FIG. 13 is a bottom plan view of the discharge valve seat and spring member of FIG. 12.

FIG. 14 is a perspective view of the head or discharge valve actuating member of the invention.

FIG. 15 is an enlarged view in section of the head and discharge valve actuating member and is taken along line 15—15 in FIG. 14.

FIG. 16 is a view in section taken along line 16—16 of FIG. 15.

FIG. 21 is an enlarged view in section of the rotary actuator for the dispensing device of the invention and is taken along line 21—21 in FIG. 22.

FIG. 22 is a fragmentary view looking toward the bottom of the rotary actuator in FIG. 21.

FIG. 27 is a fragmentary view in section of the manifold of FIG. 23 and is taken along line 27—27 in FIG. 26.

FIG. 28 is a greatly enlarged fragmentary sectional view of the slow leak back and pressure relief valve of the invention and is taken along line 28—28 in FIG. 26.

FIG. 29 is a greatly enlarged fragmentary view in section of the inlet valve of the invention and is taken along line 29—29 in FIG. 26.

FIG. 30 is a greatly enlarged fragmentary view in section of a portion of the channel for receiving the upstanding valving web on the expansible bladder and is taken along line 30—30 in FIG. 26.

FIG. 33 is a fragmentary view in section of a modified dispensing device wherein the valving structures associated with the expansible bladder are formed in a disc-like configuration, as opposed to the upstanding annular wall configuration of the preferred form of the invention.

FIG. 34 is a view similar to FIG. 33, taken at a right angle thereto.

FIG. 35 is a view of the expansible bladder and retainer taken along line 35—35 in FIG. 33.

FIG. 36 is a greatly enlarged fragmentary view in section of the vent valve of the modified form of the invention and is taken along line 36—36 in FIG. 35.

FIG. 37 is a greatly enlarged fragmentary view in section of the pressure relief valve of the modified form of the invention and is taken along line 37—37 in FIG. 33.

FIG. 38 is an enlarged view in section of the expansible bladder of the modified form of the invention.

FIG. 39 is a plan view of the expansible bladder of FIG. 38.

FIG. 40 is an enlarged view looking toward the bottom of the expansible bladder of FIG. 38.

FIG. 44 is a bottom view of the manifold in the modified form of the invention.

FIG. 45 is a greatly enlarged fragmentary view in section of a portion of the manifold taken along line 45—45 of FIG. 41 for use with the modified form of the invention.

DETAILED DESCRIPTION OF THE PREFERRED EMBODIMENT

Figure 3:
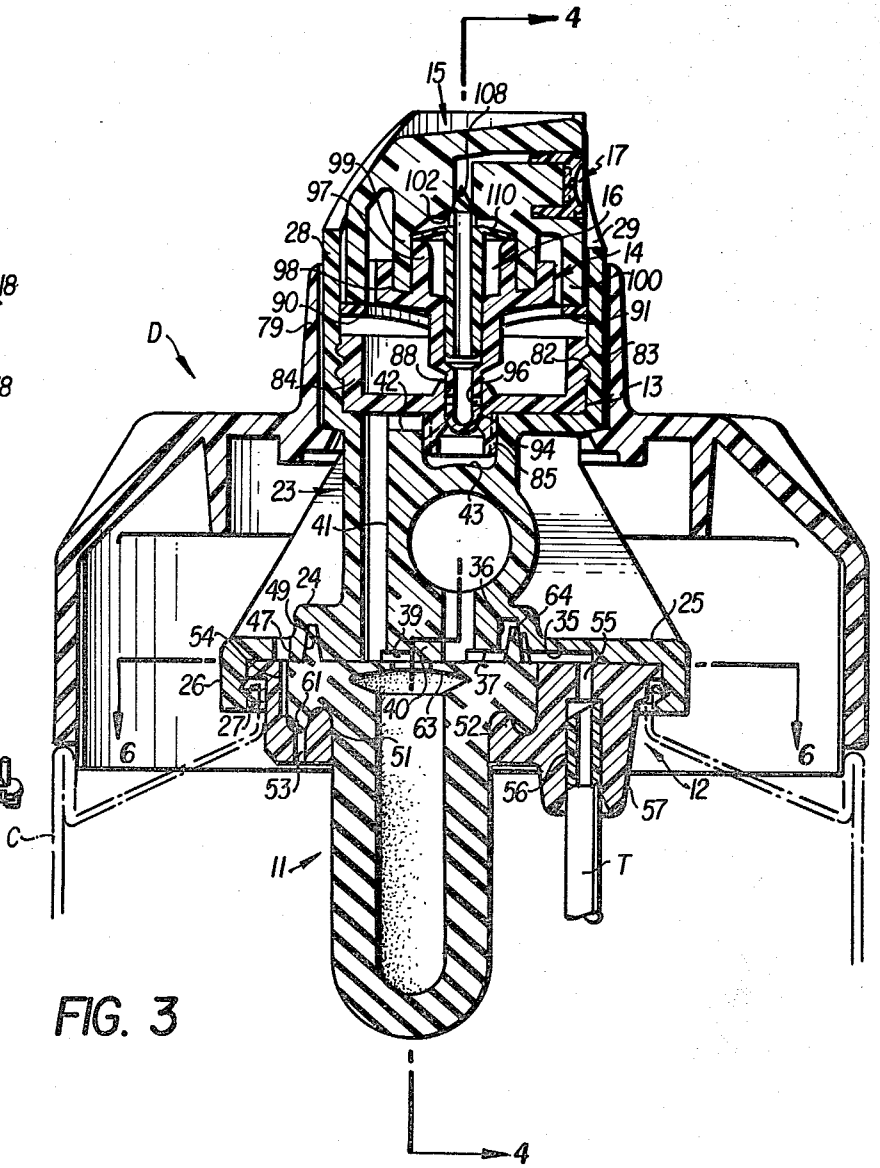
FIG. 3 is an enlarged vertical sectional view of the dispensing device of FIG. 2.

In the drawings, wherein like reference numerals indicate like parts throughout the several views, a dispensing device in accordance with the invention is indicated generally at D in FIG. 1, assembled to a container C such as a metal can or the like.

Figure 2:
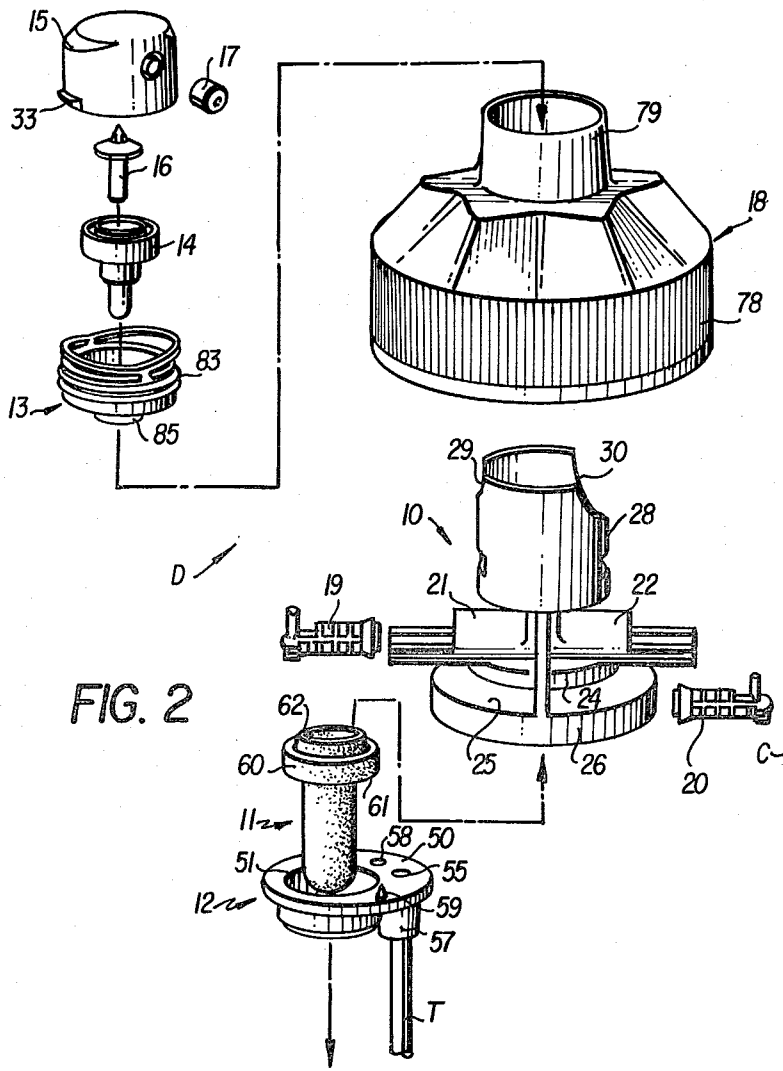
FIG. 2 is an exploded perspective view of a preferred form of the dispensing device of the invention.

As seen best in FIGS. 2 and 3, the dispensing device D comprises a one-piece molded manifold member 10 to which an elastic expansible bladder 11 is secured by means of a bladder retainer 12. A dip tube T is also carried by the bladder retainer 12 in a position for extending to adjacent the bottom of a container C with which the dispensing device is associated.

A combined spring and valve seat member 13 is also secured to the manifold and provides both a valve seat and biasing spring for a discharge valve member 14 controlled by head or discharge valve actuator 15.

A snap-acting positive shut off valve 16 is reciprocable relative to the discharge valve member 14 and head 15 and is operative to prevent flow from the dispensing device until a predetermined pressure is reached and is also operative to move to a closed position to abruptly terminate flow when pressure falls below a predetermined minimum.

A nozzle 17 is carried by the head or discharge valve actuating member 15 for imparting a desired pattern to the material discharged therethrough.

A rotatable actuator 18 is carried by the manifold and is connected with pistons 19 and 20 which are reciprocable in cylinders 21 and 22 defined in the manifold to alternately draw material from the container through the dip tube T, pressurize the material and transfer it to the expansible bladder 11 for subsequent discharge through the discharge valve, the positive shut off valve, and the nozzle.

The manifold 10, as seen in FIGS. 2 through 8 and 23 through 30, comprises a central portion 23, defined in part by the piston cylinders 21 and 22 and having a first diametrically enlarged portion 24 at the bottom end thereof with a radially enlarged wall 25 at the bottom of the first diametrically enlarged portion 24 and having a depending cylindrical wall or skirt 26 thereon. A stepped configuration 27 is formed on the inner surface of the depending skirt 26 for secure snap-fitting engagement with the margin around a central opening through a can top.

An upstanding, cylindrical superstructure or discharge valve housing 28 is formed on the top of the central portion 23 of the manifold 10 and has a pair of diametrically opposite notches or cut-outs 29 and 30 therein for a purpose described hereinafter. A second pair of notches or slots 31 and 32 are formed in the superstructure 28 between the upper and lower ends thereof for cooperation with outwardly projecting detents 33 and 34 on the head or discharge valve actuating member 15.

Figure 26:
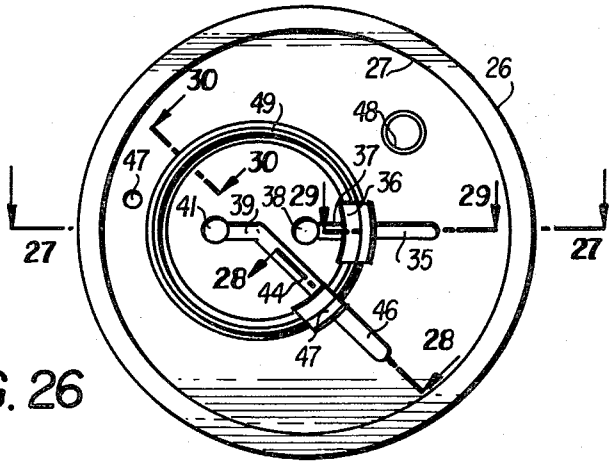
FIG. 26 is a bottom plan view of the manifold of FIG. 23.
Figure 23:
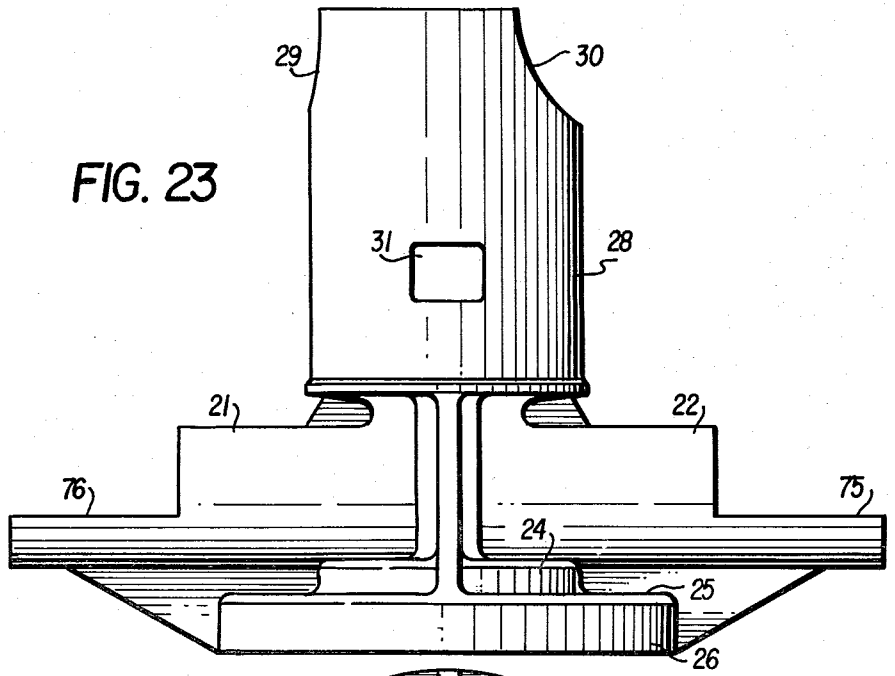
FIG. 23 is a side view in elevation of the manifold of the preferred form of the invention.
Figure 25:
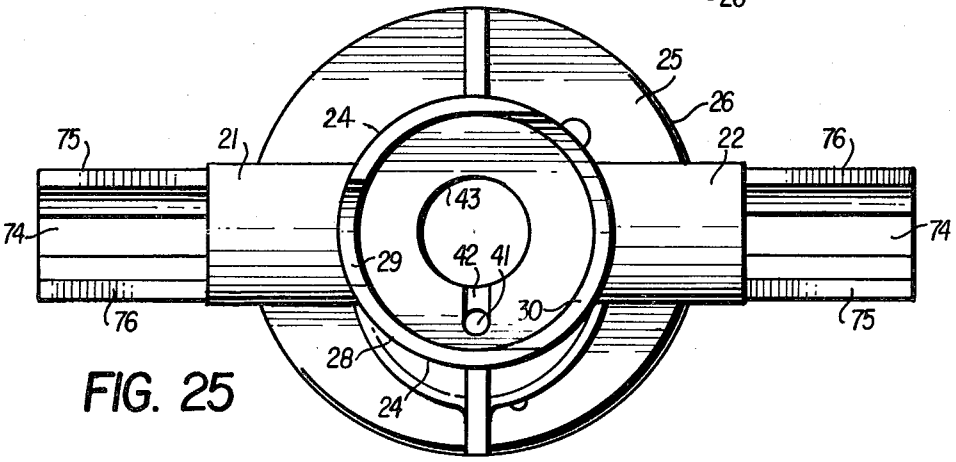
FIG. 25 is a plan view of the manifold of FIG. 23.
Figure 42:
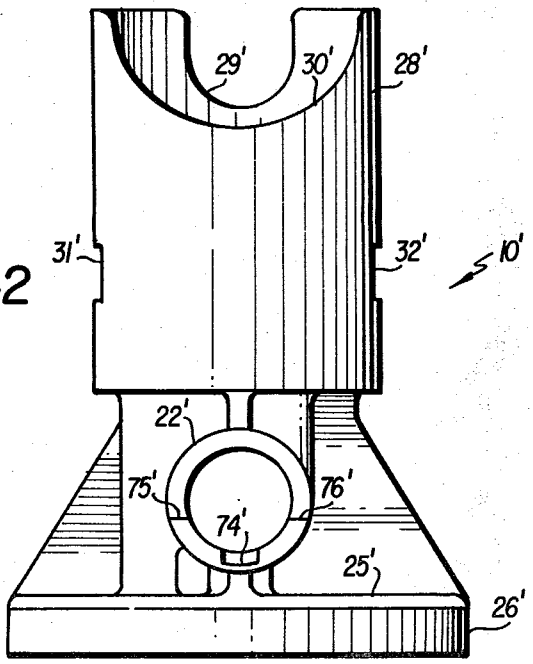
FIG. 42 is a view similar to FIG. 24, for use with the modified form of the invention.
Figure 41:
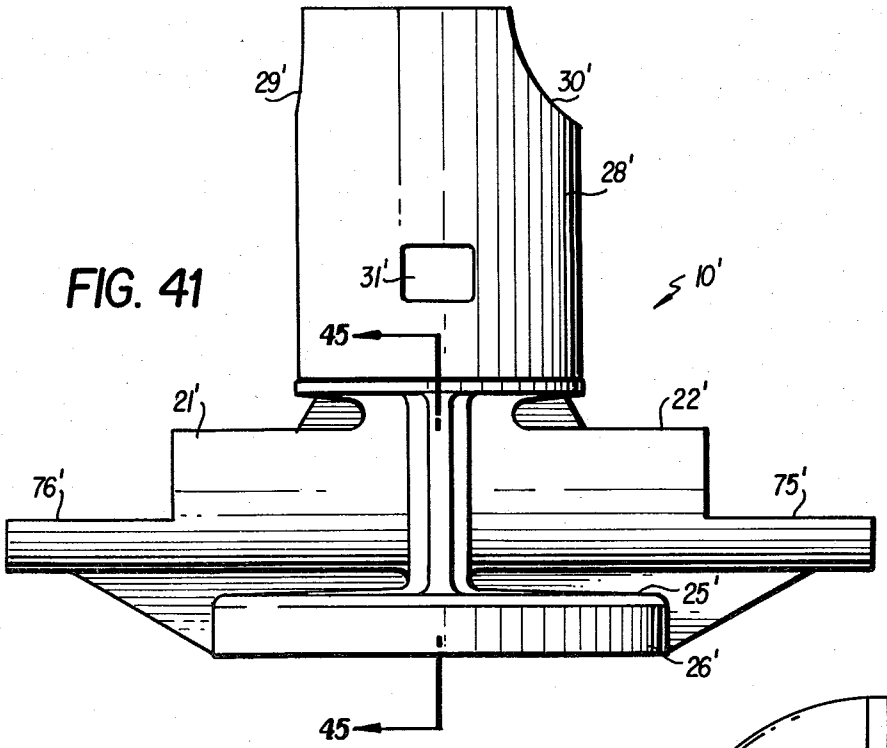
FIG. 41 is a view similar to FIG. 23 of the manifold for use with the modified form of the invention.
Figure 43:
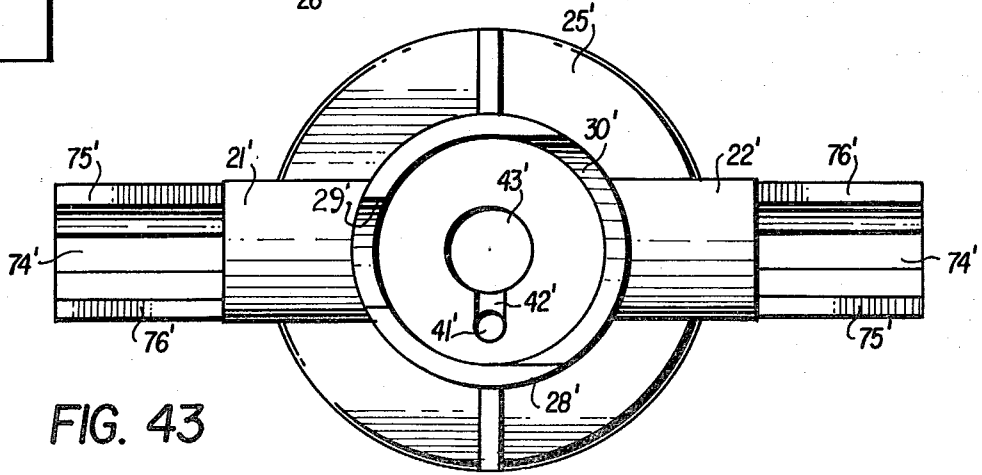
FIG. 43 is a view similar to FIG. 25, for use with the modified form of the invention.

As seen best in FIG. 26, the underside of wall 25 on the bottom of manifold member 10 has a plurality of flow passages and valving chambers defined therein, including an inlet flow channel or flow passage 35 leading to an inlet valve chamber 36 and short channel 37 leading to a pump passage or port 38 extending axially upwardly into the central portion 23 of the manifold member to communication with the piston cylinders 21 and 22 at approximately the midpoint thereof.

A relatively short, radially extending outlet channel 39 is formed in the underside of wall 25 in spaced relation to the pump port 38 and is separated therefrom by a valve land 40. The outlet channel 39 communicates with the bottom end of an axially extending outlet port or passage 41 extending upwardly through the central portion 23 and terminating at its upper end in a laterally extending channel 42 which, in turn, communicates at one end with a discharge valve chamber 43 defined in the upper end of central body portion 23 of manifold member 10.

A generally radially extending pressure relief channel 44 extends from communication with the outlet channel 39 to a pressure relief and leak back valve chamber 45, communicating with a relief channel outlet 46.

A vent opening 47 and orienting opening 48 are also formed through the wall 25, and are described in more detail hereinafter.

An annular channel 49 having a generally frustoconical configuration in transverse cross-section is also formed in the underside of wall 25 within the diametrical limits of the first radially enlarged portion 24 and extends through the valving chambers 36 and 45.

The retainer 12 has a disc-shaped top wall 50 with an outer diameter approximately equal to the inner diameter of skirt 26 and adapted to be secured therein when the dispensing device is secured to a container as indicated in FIG. 3, for example. The retainer has an opening 51 therethrough for receiving the expansible bladder or accumulating chamber 11 and an upstanding flange 52 surrounds the opening 51, defining a sinuous configuration in transverse cross-section for cooperation with the bladder to retain it in position. A vent port 53 extends upwardly through the retainer in radially outwardly spaced relation to the opening 51 and is normally closed by the bladder. A continuation 54 of the vent opening extends upwardly through the upper surface of wall 50 of the retainer and communicates at its upper end with the vent opening 47 through the wall 25 of manifold member 10.

An inlet passage 55 is also formed through the retainer and communicates with a diametrically enlarged passage 56 adapted to receive and hold the end of dip tube T, the passage 56 being formed in a depending boss 57 on the underside of the retainer.

The retainer also has a pressure relief and bleed back port or passage 58 formed through the wall 50 thereof communicating at its upper end with the outer end of passage 46, and at its lower end with the interior of the container with which the device is associated.

An upstanding orienting pin 59 is formed on the top of wall 50 in a position to be received through the orienting opening 48 in wall 25 of manifold member 10, whereby the flow passages and valving chambers and the like are properly aligned with one another.

The expansible bladder or accumulating chamber 11 has a diametrically enlarged flange 60 on its upper end with a depending wall or skirt 61 adapted to be received by the sinuous configuration defined by flange 52 on the retainer, with the skirt 61 normally disposed in closing relationship to the vent passage 53. As seen in FIG. 3, an upstanding annular valving wall 62 having substantially a frustoconical configuration in transverse cross-section is formed on the upper end surface of bladder 11 and is snugly received in the channel 49 formed in the underside of wall 25 extending into the first diametrically enlarged portion 24 of manifold member 10.

A radially extending valving web 63 is also formed on the upper end surface of the bladder in coaxial relationship with the annular upstanding valving wall 62, and the valving web 63 normally abuts against the valving land or seat area 40 defined on the underside of wall 25 of manifold member 10 and serves as an outlet check valve from the pump passage 38. The annular valving wall 62 also extends through the inlet valve chamber 36 and pressure relief and leak back valve chamber 45 and cooperates with valve seat areas defined therein to form an inlet check valve 64 which opens to admit fluid from the dip tube to the pump passage 38 when the pistons move outwardly relative to one another, and which closes when the pistons move toward one another. Similarly, the valve 63 opens when the pistons move toward one another, to admit pressure fluid to the interior of the expansible bladder 11, and closes to prevent reverse flow therethrough when the pistons move apart relative to one another. The valve seat 65 in the pressure relief and leak back valve chamber 45 is roughened or otherwise treated whereby seating of the pressure relief valve 66 thereon is not leak proof, and accordingly, product stored under pressure in the expansible bladder slowly leaks past the valve 66 to return to the container. The leakage is such that in one embodiment of the invention, approximately five minutes is required for the product to leak back. Thus, the leakage does not affect normal operation of the device but does provide a child safety feature since the bladder cannot be charged with product and left unattended for long periods of time.

The pressure relief valve 66 will open to return excessive pressure from the bladder to the container in the event an effort is made to overcharge the bladder. Thus, damage to the dispensing device is precluded.

Figure 31:
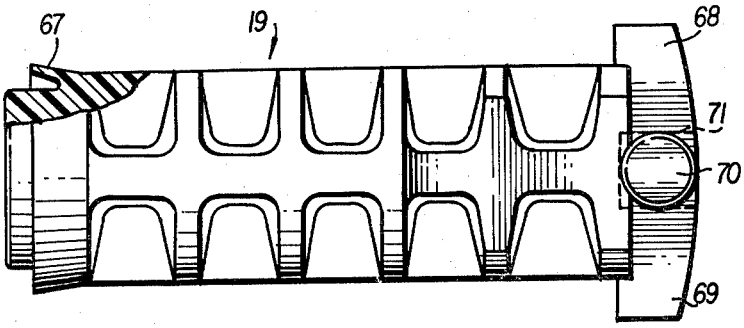
FIG. 31 is a greatly enlarged plan view of a first form of piston for use with the dispensing device of the invention.
Figure 32:
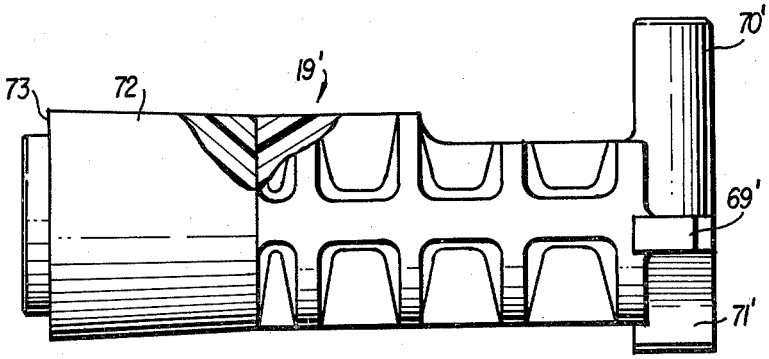
FIG. 32 is a side view in elevation of a modified piston for use with the invention.
Figure 24:
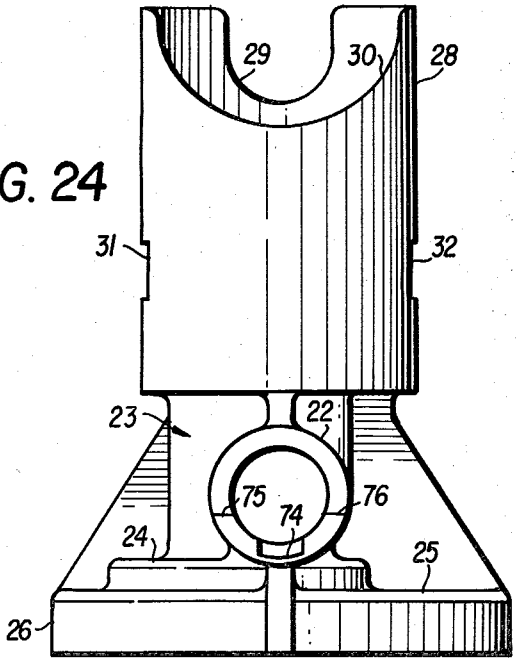
FIG. 24 is a view in elevation of the manifold taken in a plane at 90° to the plane of the view in FIG. 23.

In FIGS. 31 and 32, two different forms of piston for use with the device of the invention are illustrated at 19 and 19', respectively, and the piston 19 in FIG. 31 is of one-piece construction and includes an outwardly and forwardly flared sealing skirt 67 on its forward end and a pair of oppositely laterally outwardly directed guide flanges 68 and 69 on its rearward end with an upstanding actuating post or pin 70 and a downwardly projecting guide pin or post 71.

The modified piston 19', on the other hand, is of two-piece construction and includes a relatively soft sealing end portion 72 including an outwardly and forwardly flared sealing skirt 73. An upstanding actuating pin or post 70', downwardly projecting guide pin 71' and oppositely laterally directed guide webs or flanges 68' and 69' are provided on this form of piston just as with the previous form.

Figure 5:
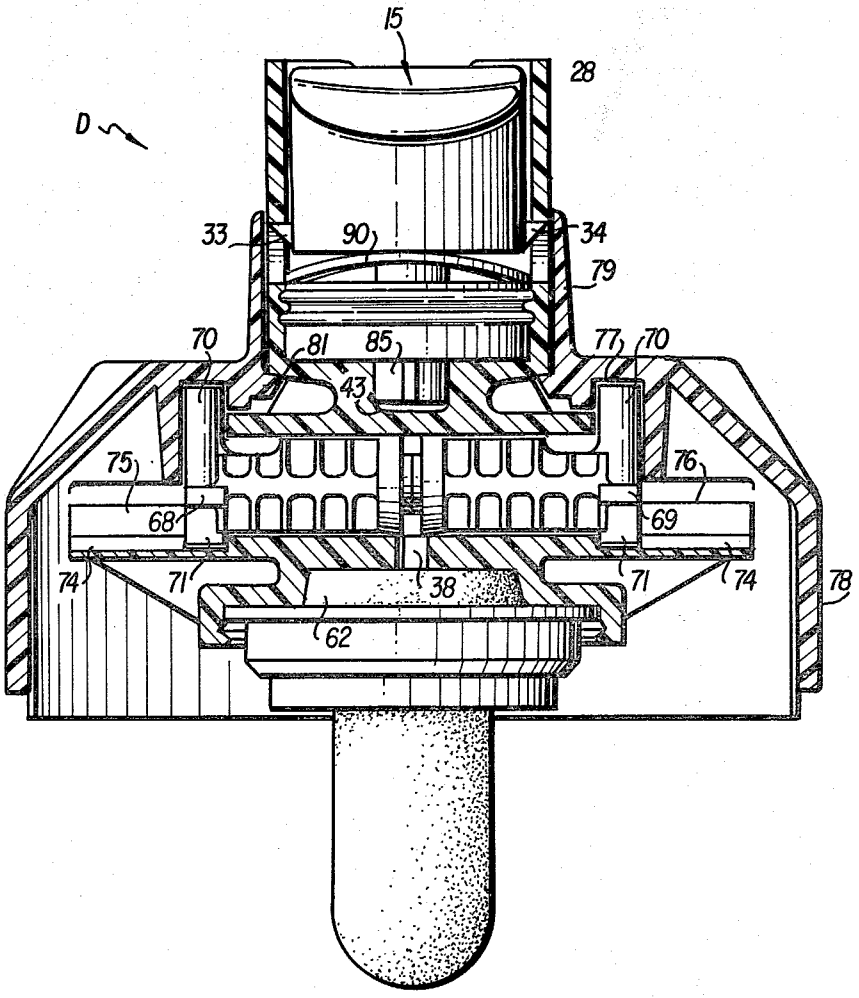
FIG. 5 is a view similar to FIG. 4, showing the pistons in their inner positions.
Figure 4:
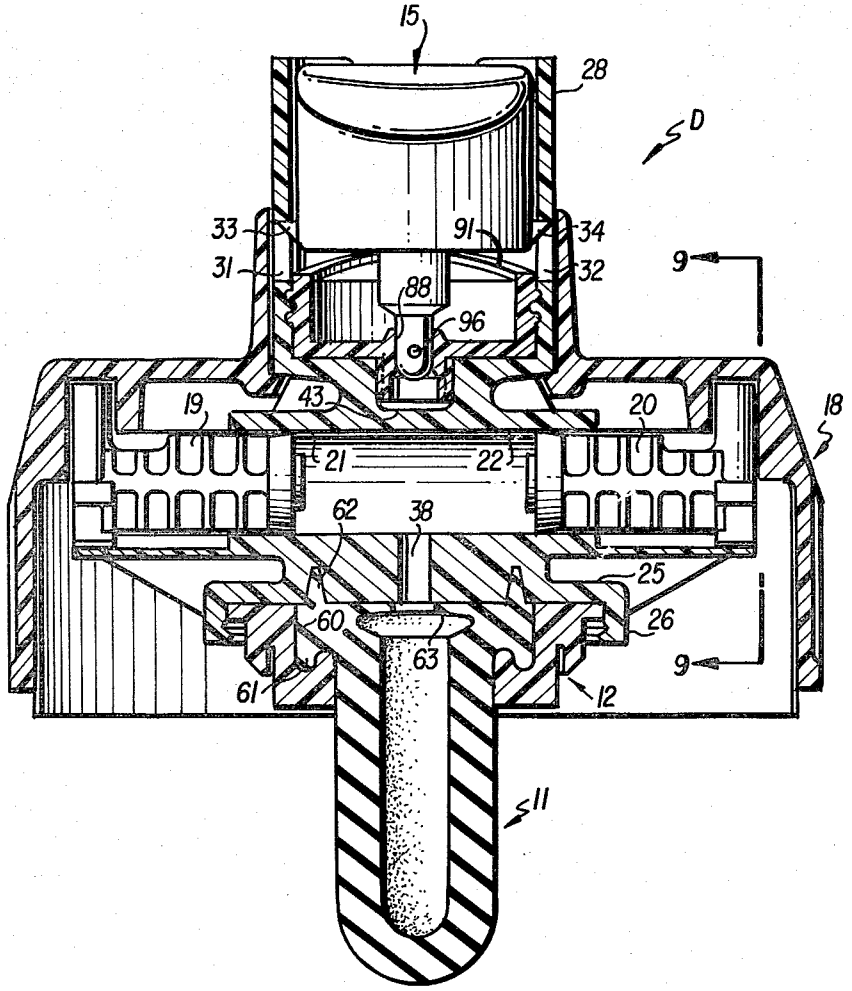
FIG. 4 is a view similar to FIG. 3 taken along line 4—4 of FIG. 3, and showing the pistons in their outward positions.

Thus, as seen in FIGS. 4, 5 and 9, when the pistons 19 and 20 are received in their respective cylinders the downwardly projecting guide pin or post 71 is received in a guide channel 74 formed in the bottom rearward end portion of the respective cylinders and the oppositely directed guide flanges 68 and 69 rest upon the upwardly facing guide surfaces 75 and 76 defined by the semi-cylindrical structure at the rearward end of the respective cylinders.

The upstanding actuating pins or posts 70 of the pistons are received in a sinusoidally-shaped cam track or actuating channel 77 formed on the underside of the rotary actuator 18, whereby upon rotation of the actuator the pistons are caused to alternately move inwardly toward one another as seen in FIG. 5 and then move outwardly away from one another as seen in FIG. 4. The actuator includes a downwardly extending cylindrical skirt 78, which extends in substantially enclosing relationship to the dispenser and terminates adjacent the upper edge of the side wall of the container C to present a neat appearance and also to prevent access to the pistons and other structure of the dispensing device, and also to provide axial support to prevent damage to the unit. The actuator 18 also includes a reduced diameter, upstanding cylindrical wall 79 having a central opening 80 therethrough with an annular, radially inwardly projecting rib or locking flange 81 surrounding the opening 80 for engagement of the locking rib 81 beneath the bottom edge or shoulder of superstructure 20 on manifold member 10, so that the actuator is non-removably secured to the manifold but yet is rotatable relative thereto.

The interior wall surface of the superstructure 28 of manifold member 10 includes one or more annular retaining rings 82 or the like for cooperation with similar means 83 on the exterior wall surface of the upstanding cylindrical wall 84 of the discharge valve seat and spring 13, whereby the valve seat and spring member is securely retained in position within the manifold. The combined seat and spring member 13 also has a reduced diameter, downwardly projecting portion 85 which extends into the discharge valve chamber 43 and has a plurality of axially extending channels 86 therein, whereby flow is enabled to occur from the outlet passage or port 42 into the valve chamber 43 and thence upwardly through the hollow interior 87 of the combined seat and spring member 13. The opening 87 has a reduced diameter upper end portion 88 with a slightly flared upper end 89.

A pair of diametrically opposite, generally semi-circular spring loops 90 and 91 are integrally molded on the upper edge surface of side wall 84 of seat and spring member 13 to bias the discharge valve 14 and head 15 upwardly to the position seen in FIGS. 3, 4 and 5.

The discharge valve 14 includes a cylindrical intermediate portion 92 having an axial bore 93 therein, and terminating at its lower end in a reduced diameter valving portion 94 having an axial bore 95 communicating at its upper end with the bore 93 and having a plurality of radially extending inlet ports 96. A pair of substantially concentric, upwardly projecting cylindrical walls 97 and 98 are formed on the upper end of intermediate portion 92, and the concentric walls 97 and 98 are normally secured to the lower edge of a downwardly projecting cylindrial wall 99 on the head 15.

The head also includes a cylindrical outer wall 100 which is slidably received within the superstructure 28 of manifold member 10, and as indicated previously, has a pair of outwardly projecting tabs 33 and 34 thereon, which are received in openings or slots 31 and 32 in the superstructure 28 to enable limited reciprocation of the head 15 but to prevent its removal from the manifold member. The lower edge of skirt or side wall 100 abuts against the spring loops 90 and 91 whereby the head and thus the discharge valve member are normally biased upwardly as seen in FIG. 3.

As seen best in FIGS. 3 and 4, the valving portion 94 of discharge member 14 is sealingly and slidably engaged in the port or passage 88 in the combined valve seat and spring member 13 and the radial ports 96 therein are normally sealed or closed to flow therethrough. However, when the head 15 is pressed downwardly against the bias of springs 90 and 91, the discharge valve member is also moved downwardly and the valving portion 94 thereof moves downwardly through the opening 88 until the ports 96 come into registry with the larger passage 87 in the seat member, whereby communication is established with the discharge valve chamber 43 to enable flow to the interior of the discharge valve member.

The head or discharge valve actuator 15 also has a generally frustoconical shaped wall 101 at the inner upper end of inner cylindrical wall 99; and a second, reduced diameter, generally frustoconically shaped valve seat 102 is formed at the upper end of wall 101. Valve seat 102 leads to an outlet passage 103 which, in turn, communicates with an annular outlet channel 104 leading to the nozzle 17. A nozzle spud 105 is molded in the head for receiving the nozzle 17, and the spud and nozzle may be of conventional construction.

As seen best in FIGS. 3 and 10, the snap-acting positive shut off valve 16 includes an elongate tubular body 106 having an axial bore or passage 107 extending therethrough and terminating at a closed, conically shaped end 108 defining a valve head or member. A pair of radial openings or slots 109 are formed through the body 106 at the base of the valve head 108 for establishing communication between the interior of the positive shut off valve and the outlet passage 103 in the head 15 when the valve 108 is open. A diametrically enlarged, combined snap-acting spring element and diaphragm 110 is molded on the body 106 closely adjacent the base of valve head 108 and normally biases the valve head 108 into closing relationship against the seat 102 in the head 15. In other words, the combined spring and diaphragm member 110 on the positive shut off valve 16 has a slightly arched or frustoconical configuration in its at-rest position and is engaged at its outer periphery on the upper edge of wall 97 of discharge valve member 14 and is held against the upper edge by the frustoconical wall 101 of head 15. At the same time, the frustoconical shape of wall 101 defines a chamber in which pressure fluid is admitted to act against the combined spring and diaphragm 110 via the bore 107 of valve 16 and the ports 109 between the valve head 108 and combined spring and diaphragm 110. Thus, with the valve in its normal at-rest position, as seen in FIG. 3, and assuming that the expansible bladder 11 has been charged with product to be dispensed, the head 15 is depressed thereby opening the ports 96 to the pressure fluid existing in discharge valve chamber 43 and enabling flow of the pressure fluid upwardly through the shut off valve and through the ports 109 into the chamber defined above the combined spring and diaphragm member 110. When the pressure builds to a valve dependent upon the yield strength of the spring 110, the valve 16 snaps to an open position with the head moved away from seat 102, thereby enabling flow to occur to and through the nozzle 17, travel restricted by abutment of the lower end of tube 106 to frustoconical surface of lower portion of inner chamber 93 of valve member 14. When the pressure drops below the biasing force of the spring 110, the valve 16 snaps closed against the seat 102, thereby abruptly terminating flow and preventing a wet stream or dribble of material as might occur upon pressure deterioration.

Figure 17:
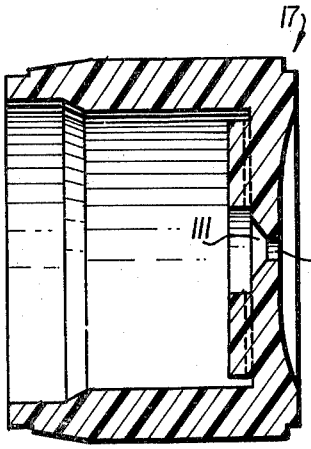
FIG. 17 is a greatly enlarged view in section of the nozzle member used with the discharge valve head of the invention.
Figure 18:
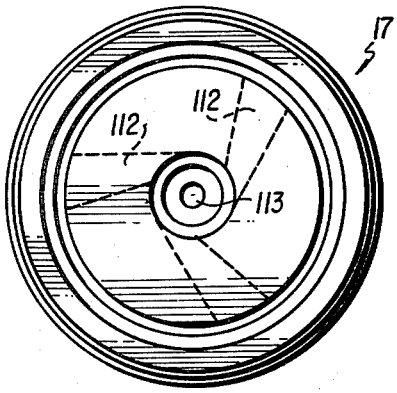
FIG. 18 is a front view in elevation of the nozzle of FIG. 17.
Figure 19:
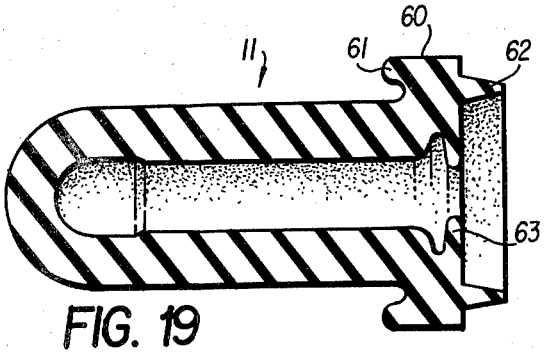
FIG. 19 is an enlarged view in section of the expansible bladder used with the preferred form of the invention.
Figure 20:
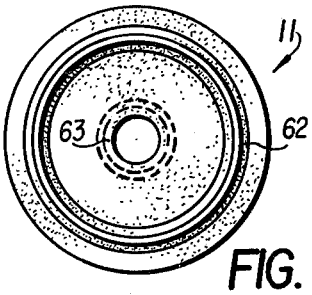
FIG. 20 is an end view of the expansible bladder of FIG. 19.

As seen in FIGS. 17 and 18, the nozzle 17 may have a swirl chamber 111 defined on the rear face thereof, with a plurality of flow channels 112 extending tangentially thereto for conducting flow from the channel 104 and head 15 to the outlet orifice 113 through the nozzle.

MODIFICATION

A modification of the dispensing device of the invention is illustrated in FIGS. 33 through 45, and like parts are referred to by like reference numerals primed.

Essentially, this form of the invention is substantially identical to that previously described, except that rather than the upstanding valving flange or wall 62 on the expansible bladder, as in the preferred form of the invention, the expansible bladder 11' in this modification has a substantially disc-like enlargement 114 at the top or open end of the bladder and valving flaps are formed therein to comprise the inlet valve 64', pressure relief valve 66' and a vent valve 115 formed in part by an opening 116 through the disc-like enlargement 114.

The retainer 12' is also slightly modified to accomodate the different valve structure and includes a recess 117 in the upper surface thereof defining a valve surface around inlet port 55' against which the inlet flap valve 64' normally is seated. Similarly, a pressure relief opening or port 58' is formed through the retainer 12' and is enlarged at the upper surface of the retainer to define a substantially frustoconically shaped cavity or pressure relief valve accomodating chamber 118 in which the pressure relief valve 66' is enabled to flex to open the central port or opening 119 therethrough upon the occurrence of excessive pressure.

The vent valve 115 is clamped between the retainer 12' and the wall 25' of manifold 10', and the upper surface of the retainer 12' has a recessed cavity or chamber 120 therein in communication with a vent opening 53' opening into communication with the interior of the container with which the device is associated. In use, when product is pumped from the container and a low pressure is created therein, the differential in pressure between atomosphere and the interior of the container causes the disc-like portion 114 in the area of vent valve 115 to flex away from the wall 25' and into the chamber 120 thereby opening the port 116 to flow from the vent opening 47' to the opening 53'. A downwardly projecting sealing rib 121 is formed on the underside of wall 25' for effecting a secure sealed engagement of the disc portion 114 between the manifold and retainer.

Thus, except for the absence of the intermediate portion 24, which accomodates the upstanding valve wall 62 in the preferred form of the invention, and with the exception of the changes discussed immediately above, this form of the invention is identical to that previously described, and also includes the positive shut off valve of the preferred form of the invention.

In both forms of the invention, only a minimum number of twists of the rotary actuator 18 are sufficient to charge the expansible bladder or accumulating chamber 11 or 11' with an amount of material to obtain a relatively long duration discharge. Moreover, there are no metal parts in the dispensing device of the invention and thus the device is compatible with more products than many prior art devices which do utilize metal components.

Further, once the accumulating chamber or expansible bladder 11 or 11' is charged with material, the device may be operated in any position without affecting spray performance thereof. Additionally, the snap-acting positive shut off valve 16 prevents a wet stream or dribble of material due to pressure deterioration as the product is exhausted from the bladder 11, and insures that a high pressure spray is obtained throughout a dispensing operation.

The dispensing device of the present invention is relatively compact and occupies very little volume, thereby enabling compact and well designed containers to be utilized. Further, this feature enables most of the container volume to be occupied by product.

Still further, while the invention has been shown as applied to a can with a crimped connection thereto, the invention could equally as well be applied to threaded containers or the like, if desired.

Various materials may be used in the manufacture of the dispensing device of the invention, and in accordance with one specific embodiment, it is contemplated that polypropylene could be used for the manifold member 10 and the actuator 18 and retainer 12, while high density polyethylene could be used for the head 15, low density polyethylene used for the discharge valve member 14, and medium density poylethylene used for the pistons 19 and 20. The positive shut off valve 16 and combined discharge valve member seat and spring 13 could be made of acetal, if desired. It should be understood that these materials are not intended to be limiting, but are exemplary of operative materials.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to be embraced by those claims.

We claim:

1. An aerosol dispenser, comprising: a container for material to be dispensed, said container having a side wall, a closed end and an open end; and dispensing means carried by the container at the open end thereof and having an outlet for dispensing material from the container, said dispensing means including manually operated expansible chamber means for pressurizing the material, an expansible accumulating chamber for accumulating a quantity of the material under pressure from the expansible chamber means, and discharge means for discharging the pressurized materi l from the accumulating chamber said discharge means including a manually operated valve for releasing pressurized material from the accumulating chamber, and a snap-acting positive shut off valve separate from the accumulating chamber and operative in response to pressure of material released by the manually operated valve to abruptly open and enable discharge of material to atmosphere when the pressure rises above a predetermined minimum and to terminate flow when the pressure falls below a predetermined minimum.

2. An aerosol dispenser as in claim 1, wherein: the manually operated valve is normally closed and precludes flow from the device until the discharge valve is opened; and said snap-acting positive shut off valve is between the manually operated discharge valve and outlet from the dispensing device.

3. An aerosol dispenser, comprising: a manifold member having means thereon for attachment to a container; first expansible chamber means carried by the manifold member; manually operable actuating means carried by the manifold member and connected with the first expansible chamber means to operate the first expansible chamber means; second expansible chamber means carried by the manifold member and comprising an elastomeric bulb adapted to receive and store a quantity of material under pressure, the pressure being provided by the elasticity of the bulb; and valve means associated with the manifold member and with the first and second expansible chamber means to control flow from a container with which the dispensing device is associated into the first expansible chamber means, from the first expansible chamber means into the second expansible chamber means for accumulation of a quantity of material to be dispensed, and from the second expansible chamber means to a point of use; said dispensing device including a discharge means with an outlet for material from the device; a snap-acting positive shut off valve in the discharge means in addition to the valve means for controlling flow from the second expansible chamber means to a point of use, operative to open and enable flow from the device only when the pressure of the material being dispensed is above a predetermined minimum, and snapping closed when the pressure falls below said minimum to abruptly terminate flow.

4. An aerosol dispenser as in claim 3, wherein the manifold member comprises a mid body portion, a top body portion and a bottom body portion, said elastomeric bulb being secured to the bottom body portion, and the first expansible chamber means being carried by the said mid body portion.

5. An aerosol dispensing device as in claim 4, wherein the actuating means comprises a rotatable, annularly shaped member carried by the manifold and disposed in covering relationship to the mid body portion of the manifold member.

6. An aerosol dispensing device as in claim 5, wherein the manifold member is of one-piece construction, and the first expansible chamber means comprises piston and cylinder means, the cylinder means being formed integrally in the manifold member.

7. An aerosol dispensing device as in claim 3, wherein the valve means includes a plurality of one-way check valves connected between the container and the first expansible chamber means and between the first expansible chamber means and the second expansible chamber means, and a manually operated discharge valve connected between the second expansible chamber means and a dispensing nozzle.

8. An aerosol dispensing device as in claim 7, wherein the manually operable discharge valve means includes a reciprocable valve member movable between closed and open positions, and spring means engaged with the valve member normally urging it to a closed position.

9. An aerosol dispensing device as in claim 8, wherein a discharge spray head is connected to the reciprocable valve member and is manually engageable to move the valve member to its open position.

10. An aerosol dispenser as in claim 9, wherein the manifold member includes an upstanding cylindrical superstructure and the discharge valve means includes a combined discharge valve seat and spring member secured within the superstructure of the manifold member and having an elongate passage therethrough in communication with a discharge valve chamber which, in, turn is in communication with the interior of the expansible bulb, spring means formed integrally with said combined discharge valve seat and spring member, a discharge valve member having an elongate valving portion sealingly and slidably received in said elongate seat passage and being connected with a discharge valve head whereby operation of the head causes reciprocation of the discharge valve member to open the discharge valve to flow of fluid from the expansible bulb to the positive shut off valve, said positive shut off valve being reciprocable toward and away from a valve seat down stream from the discharge valve member.

11. An aerosol dispenser as in claim 10, wherein the snap-acting positive shut off valve comprises an elongate tubular member having an open inlet end and a valve head at the other end, a diametrically enlarged, combined spring and diaphragm element integral with the positive shut off valve adjacent the valve head and between the valve head and open inlet end thereof, said combined spring and diaphragm element engaged and held at its periphery between the discharge valve member and the discharge valve head, and flow passages leading from the interior of the positive shut off valve to a chamber defined above the combined spring and diaphragm element whereby when the discharge valve member is opened, pressure fluid is enabled to flow above the combined spring and diaphragm element and when the pressure reaches a predetermined value the positive shut off valve is moved to an open position to enable the material to flow through the nozzle, said combined spring and diaphragm element normally biasing the positive shut off valve closed so that when the pressure falls below a predetermined minimum the positive shut off valve is returned to its seat with a snap action thereby abruptly terminating flow to and through the nozzle.

12. An aerosol dispenser as in claim 11, wherein an annular bulb retainer is engaged against the flange, holding the flange and bulb against the underside of the manifold member, said manifold member having a vent opening extending therethrough in a position adjacent the outer margin of the flange on the expansible bulb, said retainer also having a vent channel therein extending in contiguous relationship with the outer margin of said flange, and said flange normally engaged against the retainer to close said vent opening and being movable to open the vent opening when the expansible bulb is filled with material, said manifold member including an upstanding cylindrical superstructure and a discharge valve means including a combined discharge valve seat and spring member secured within the superstructure of the manifold member and having an elongate passage therethrough in communication with a discharge valve chamber which, in turn, is in communication with the interior of the expansible bulb, spring means formed integrally with said combined discharge valve seat and spring member, a discharge valve member having an elongate valving portion sealingly and slidably received in said elongate seat passage and being connected with a discharge valve head, whereby operation of the head causes reciprocation of the discharge valve member to open the discharge valve to flow of fluid from the expansible bulb to the positive shut off valve, said positive shut off valve being reciprocable toward and away from a valve seat downstream from the discharge member.

13. An aerosol dispenser as in claim 9, wherein: the actuating means comprises a rotatable, annularly shaped member carried by the manifold and disposed in covering relationship to the mid body portion of the manifold member, said manifold member being of one-piece construction, and the first expansible chamber means comprising piston and cylinder means, the cylinder means being formed integrally in the manifold member, and said elastomeric bulb and the check valve means comprise an integrally molded one-piece construction, the check valve means being formed in a radially enlarged, generally circularly shaped valving disc integral with the bulb.

14. An aerosol dispenser as in claim 13, wherein the bottom body portion of the manifold member includes a generally circular shaped bottom wall having a cylindrical depending annular skirt thereon, the under surface of the bottom wall having channels formed therein and said valving discs being disposed and held against the under surface of the manifold member bottom wall and cooperating with the channels to form flow passages, said check valves positioned at the end of the passages to control flow therethrough.

15. An aerosol dispenser as in claim 14, wherein an overpressure relief valve is formed in the valving disc and is in communication with the bulb and is openable by pressure in the bulb above a predetermined maximum pressure to return excessive fluid from the bulb back into the container.

16. An aerosol dispenser as in claim 15, wherein a vent valve is formed in said valving disc and includes an opening formed through said valving disc, said portion of the valving disc with the opening therethrough being disposed within a vent valve chamber constructed such that a differential in pressure between atmosphere and the interior of the container moves the vent valve away from its seat to open communication between the atmosphere and the interior of the container.

17. An aerosol dispenser as in claim 3, wherein the elastomeric bulb is circumferentially symmetrical and has a closed end and an open end; a diametrically enlarged flange on the open end; and a generally cylindrical, upstanding valving wall integral with the bulb at the open end, said symmetrical bulb enabling the bulb to be assembled to the manifold in any position of rotation of the bulb about its longitudinal axis.

18. An aerosol dispenser as in claim 17, wherein the bottom body portion of the manifold member includes a generally circularly shaped bottom wall having a cylindrical, depending skirt thereon, the under surface of the bottom wall having channels and valve chambers formed therein and including a circular channel in which the upstanding valving wall on the elastomeric bulb is received, said valving chambers including valve seats positioned to cooperate with the valving wall to control flow through the channels to and from the first and second expansible chamber means.

19. An aerosol dispenser as in claim 18, wherein said upstanding valving wall and one of the valving chambers in the underside of the bottom wall of the manifold member define an overpressure relief valve communicating with the bulb and openable by pressure in the bulb above a predetermined maximum pressure to return excessive fluid from the bulb back into the container.

20. An aerosol dispenser as in claim 19, wherein the overpressure relief valve and its associated seat in its valve chamber cooperate to define a slow leak back passage in communication with the bulb to slowly leak pressurized fluid from the bulb back into the container to thereby prevent the bulb from being charged or filled with fluid and left for long periods of time without being discharged.

21. An aerosol dispenser as in claim 17, wherein an annular bulb retainer is engaged against the flange, holding the flange and bulb against the underside of the manifold member, said manifold member having a vent opening extending therethrough in a position adjacent the outer margin of the flange on the expansible bulb, said retainer also having a vent channel therein extending in contiguous relationship with the outer margin of said flange, and said flange normally engaged against the retainer to close said vent opening and being movable to open the vent opening when the expansible bulb is filled with material.

22. An aerosol dispenser as in claim 17, wherein the bottom body portion of the manifold member includes a generally circular-shaped bottom wall having a cylindrical depending annular skirt thereon, the under surface of the bottom wall having channels formed therein and said upstanding valving wall being disposed and held against the under surface of the manifold member bottom wall, and cooperating with the channels to define flow passages, a retaining member engaged against the flange of the expansible bulb and securing the bulb to the depending skirt of the manifold member, said retaining member having an orienting pin thereon extended through an orienting opening in the circular shaped bottom wall of the manifold member to properly locate the flow channels and passages relative to one another.

* * * * *